US006077092A

United States Patent [19]

Chiu et al.

[11] Patent Number: 6,077,092

[45] Date of Patent: Jun. 20, 2000

[54] ELECTRICAL CONNECTOR HAVING STABILIZING STRUCTURE FOR SPACER AND TERMINAL

[75] Inventors: Allen Chiu, Taipei; Jerry Wu, Chang-Hua, both of Taiwan

[73] Assignee: Hon Hai Precision Ind. Co., Ltd., Taipei Hsien, Taiwan

[21] Appl. No.: 09/301,508

[22] Filed: Apr. 28, 1999

[30] Foreign Application Priority Data

Jan. 12, 1999 [TW] Taiwan ..... 88200435

[51] Int. Cl.[7] ..... H01R 12/00

[52] U.S. Cl. ..... 439/79

[58] Field of Search ..... 439/79, 701

[56] References Cited

U.S. PATENT DOCUMENTS 5,718,599 2/1998 Ichikawa et al. ..... 739/701

*Primary Examiner*—Khiem Nguyen
*Assistant Examiner*—Brian S. Webb
*Attorney, Agent, or Firm*—Wei Te Chung

[57] ABSTRACT

An electrical connector comprises an insulative housing, a number of terminals and a spacer. The housing comprises a body having a number of terminal-receiving passageways defined therein, and two arms extending from opposite ends of the body. The spacer is attached to the housing and comprises a first surface and a second surface. A row of terminal positioning holes is disposed in each surface of the spacer and a rectangular slot is disposed in an inner surface of each positioning hole of the first surface. The terminals are distributed in two rows, an inner first row and an outer second row, corresponding to the first and second surfaces of the spacer. Each terminal of the inner first row comprises a pair of retaining tabs interfittingly received in the corresponding rectangular slot of the spacer to properly position the spacer relative to the housing thereby preventing the spacer from deflection, deformation and adverse displacement.

4 Claims, 4 Drawing Sheets

ELECTRICAL CONNECTOR HAVING STABILIZING STRUCTURE FOR SPACER AND TERMINAL

BACKGROUND OF THE INVENTION

The present invention relates to an electrical connector, and more particularly to an electrical connector having a stabilizing structure for a spacer and terminals thereof to stabilize the spacer and prevent the spacer from deflection and deformation.

DESCRIPTION OF PRIOR ART

In accordance with a conventional electrical connector, a plurality of terminals is received in a plurality of respective terminal-receiving passageways defined in an insulative housing of the connector. One end of each terminal is retentively retained in the housing, and the other end is bent downwardly at a right angle for extending through a corresponding positioning hole disposed through a spacer and subsequently being inserted into a corresponding aperture of a circuit board. The spacer is commonly in a form of a plate with a plurality of positioning holes disposed therein for retentively retaining pin portions of the terminals extending therethrough. U.S. Pat. Nos. 5,104,329; 5,304,878 and 5,399,105 disclose such a design.

However, if the housing of the connector is elongate problems may arise. After the elongate spacer corresponding to the shape of the housing is attached to the connector housing, deflection and deformation of the spacer may result due to a lack of rigidity thereof, thereby causing misalignment relative to the connector housing. Such misalignment of the spacer causes misalignment of the pin portions of the terminals relative to the apertures of the circuit board.

To solve such a problem, locking means is formed on the spacer engaging with a bottom of the housing thereby stabilizing the spacer with respect to the housing. However, in some cases, in order to reduce the mounting height of the connector, the housing of the connector is so positioned as to project outside a printed circuit board and has its bottom below the circuit board. In these cases, it is impossible to use the locking means on the spacer to engage with the bottom of the housing, resulting in that the spacer can not be retained in position. To solve the aforesaid problems, the present invention provides an electrical connector having an improved spacer and terminal to stabilize the spacer relative to the housing and prevent the spacer from deflection, deformation, and adverse displacement.

SUMMARY OF THE INVENTION

One object of the present invention is to provide an electrical connector having an improved spacer and terminals, each terminal comprising a retaining tab received in a rectangular slot of the spacer thereby preventing the spacer from deflection, deformation, and adverse displacement.

To achieve the object set forth, the electrical connector in according with the present invention comprises an insulative housing, a plurality of terminals and a spacer. The housing comprises a body having a plurality of terminal-receiving passageways defined therein, and two arms extending from opposite ends of the body. The spacer is attached to the housing and comprises a first surface and a second surface parallel to the first surface. A row of terminal positioning holes is disposed in each surface of the spacer and a rectangular slot is disposed in an inner surface of each positioning hole of the first surface. The terminals are distributed in two rows, an inner first row and an outer second row, corresponding to the first and second surfaces of the spacer. Each terminal of the inner first row comprises a pair of retaining tabs interfittingly received in the corresponding rectangular slot of the spacer to properly position the spacer relative to the housing thereby preventing the spacer from deflection and deformation.

Other objects, advantages and novel features of the invention will become more apparent from the following detailed description when taken in conjunction with the accompanying drawings.

DETAILED DESCRIPTION OF THE INVENTION

Figure 1:
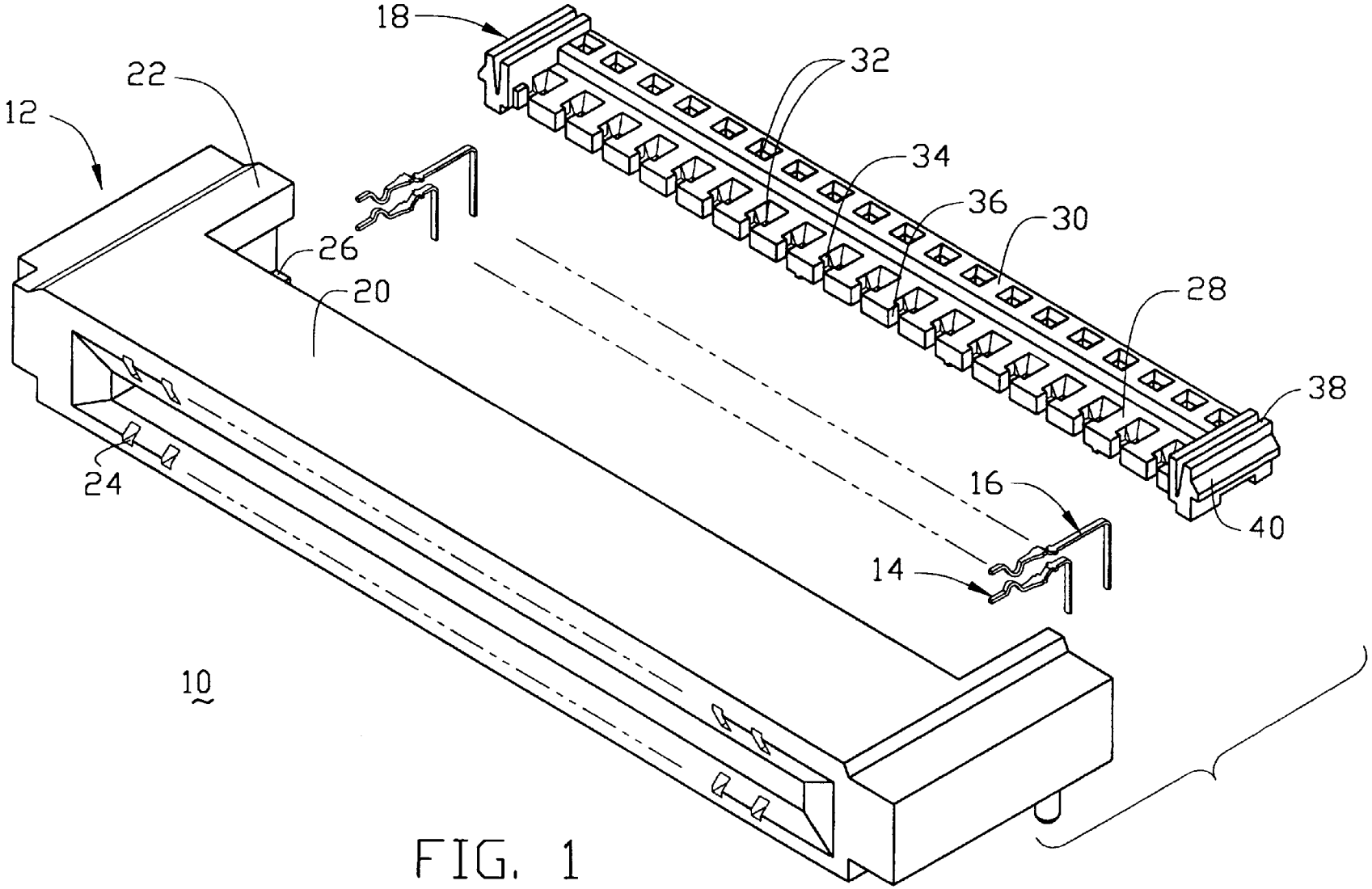
FIG. 1 is an exploded view of an electrical connector in accordance with the present invention.

Referring to FIG. 1, an electrical connector 10 in accordance with the present invention comprises a housing 12, a plurality of terminals 14, 16 and a spacer 18. The housing 12 comprises an elongate body 20, and two arms 22 extending from opposite ends of the body 20. A plurality of terminal-receiving passageways 24 is defined in the body 20 for receiving the terminals 14, 16 therein. A positioning member 26 is formed on an inner surface of each arm 22 for guiding the spacer 18 to engage with the housing 12. The spacer 18 is retained in a cavity defined between the body 20 and the two arms 22 after engaging with the positioning members 26 of the housing 12.

Figure 2:
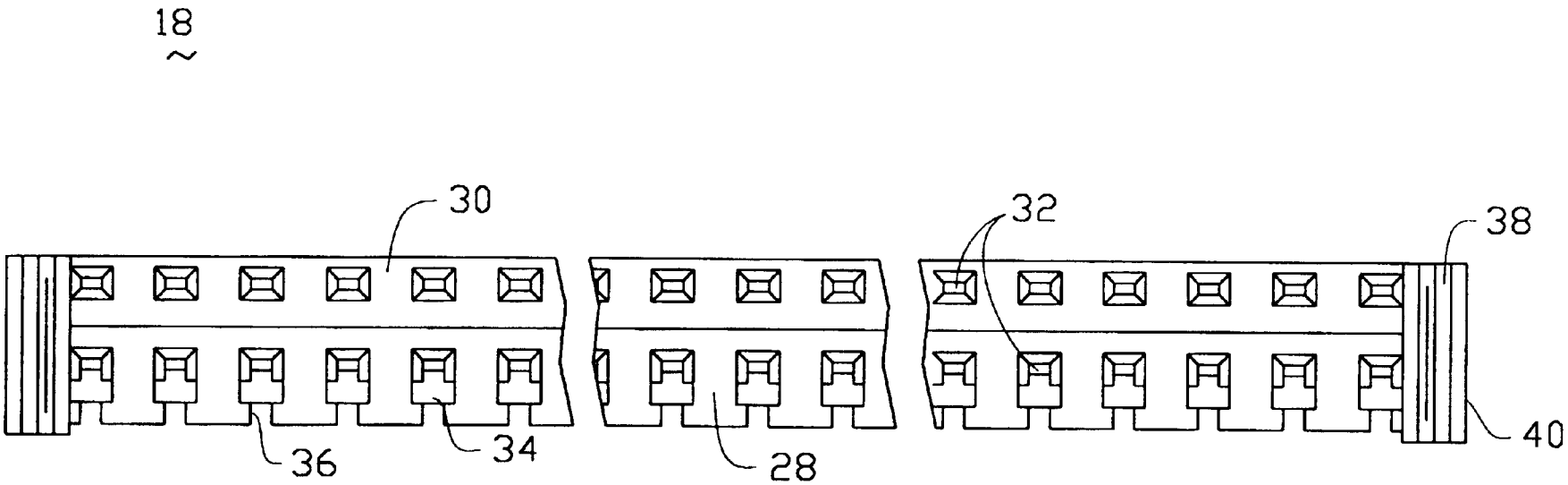
FIG. 2 is a top plan view of a spacer.

Also referring to FIG. 2, the spacer 18 is formed as an elongate plate corresponding to the housing 12 and is attached to the body 20 by means of the positioning members 26 of the housing 12. A lower first surface 28 and a higher second surface 30 parallel to the first surface 28 are formed on the spacer 18, wherein the first surface 28 faces an inner surface of the body 20 of the housing 12. A row of terminal positioning holes 32 is disposed in each surface 28, 30. Each positioning hole 32 in one surface is in alignment with a corresponding positioning hole 32 in the other surface. A rectangular slot 34 is disposed in an inner surface of each positioning hole 32 of the first surface 28 adjacent to the body 20 of the housing 12. An opening 36 is defined adjacent to the slot 34 for exposing the slot 34 to the body 20 of the housing 12. A pair of positioning blocks 38 is formed on opposite sides of the spacer 18 with a wedge-shaped sliding member 40 extending therefrom for engaging with the positioning member 26 of the housing 12 thereby attaching the spacer 18 to the housing 12.

Figure 3:
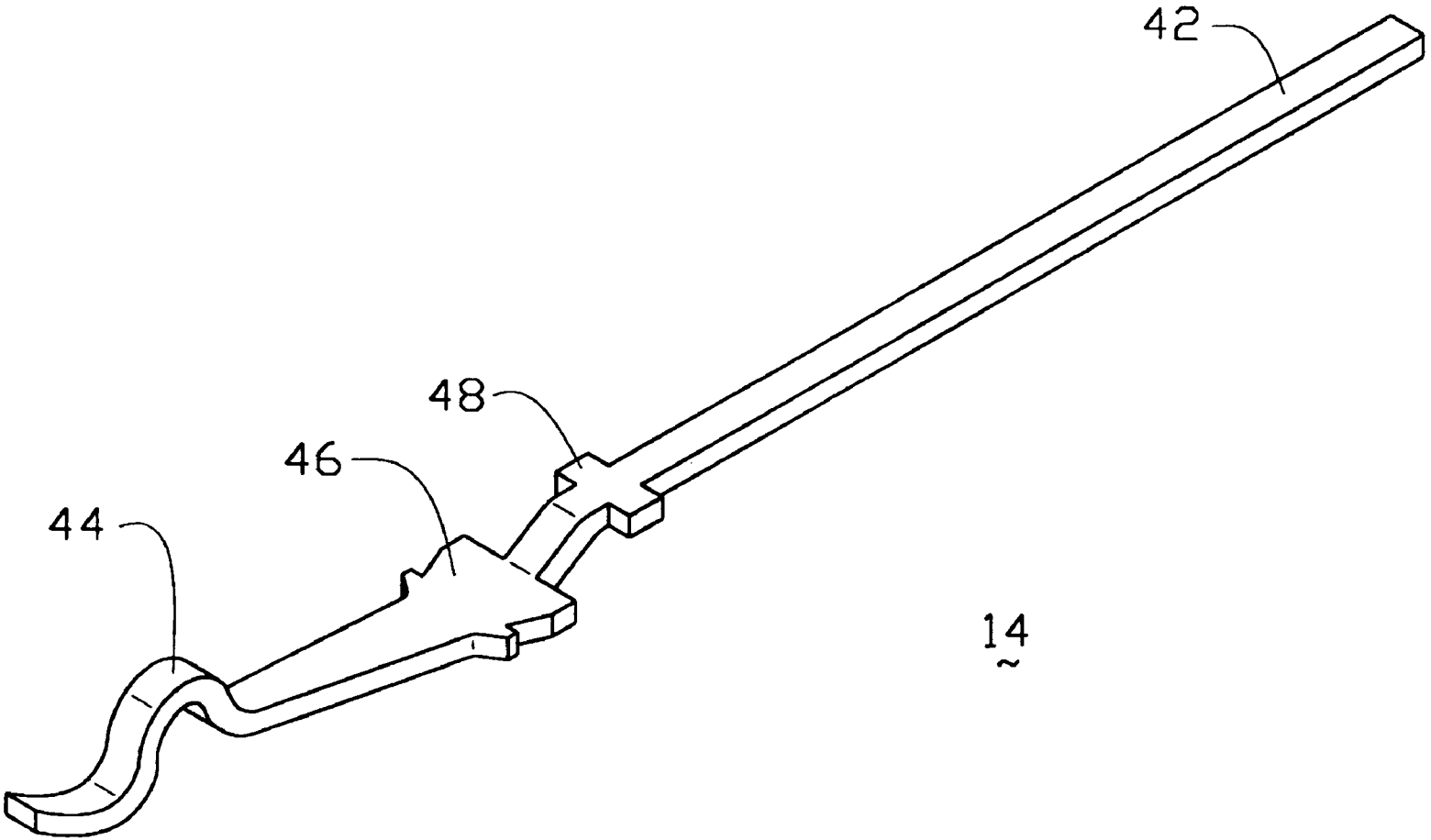
FIG. 3 is a perspective view of a terminal of an inner first row before right-angle bending.
Figure 4:
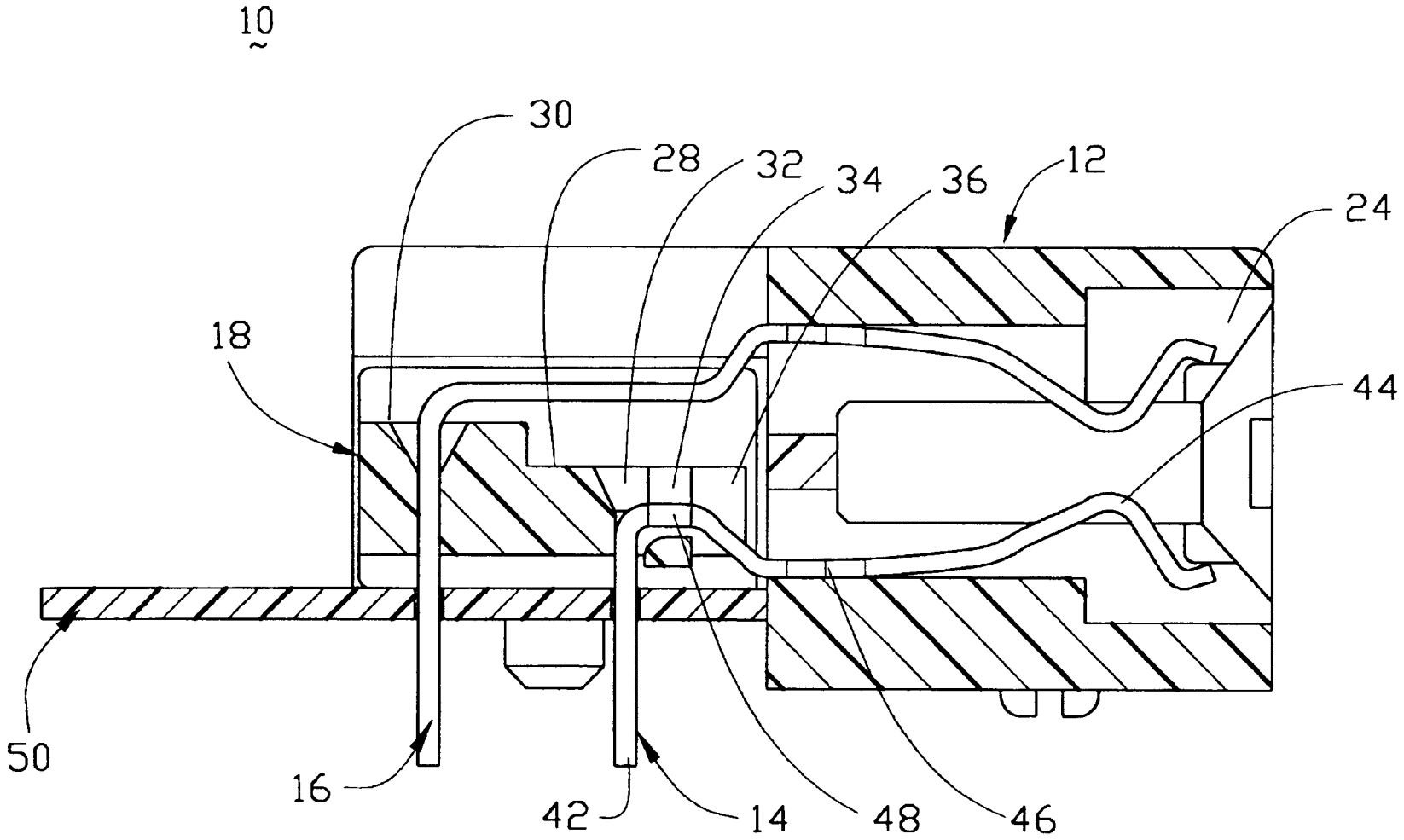
FIG. 4 is a cross-sectional view of the assembled connector.

Referring to FIGS. 3 and 4, the terminals 14, 16 are distributed in two rows, an inner first row and an outer second row. Each terminal 14 of the inner first row sequentially comprises a curved contact portion 44, an engaging portion 46 having a pair of barbs extending therefrom, a pair of retaining tabs 48 extending from opposite sides thereof and a pin portion 42. The configuration of the outer second row of the terminals 16 is similar to that of the terminals 14 of the inner first row but without the pair of retaining tabs 48. The curved contact portion 44 of each terminal 14, 16 is received in the corresponding terminal-receiving passageway 24 of the body 20 of the housing 12 and is securely retained by the engaging portion 46 for connecting with a corresponding terminal of an inserted mating connector (not shown). The pin portion 42 of each terminal 14, 16 is bent at a right angle for extending through the corresponding positioning hole 32 of the spacer 18 and subsequently being inserted into a corresponding aperture (not labeled) disposed in a circuit board 50 thereby attaching the connector 10 to the circuit board 50. The pin portions 42 of the inner first row of the terminals 14 are inserted in the positioning holes 32 of the lower first surface 28 of the spacer 18, and the retaining tabs 48 are interfittingly received in the rectangular slots 34 thereof. The pin portions 42 of the outer second row of the terminals 16 are inserted in the positioning holes 32 of the higher second surface 30 of the spacer 18.

In assembly, the curved contact portion 44 of each terminal 14, 16 is first inserted and retained in the corresponding terminal-receiving passageway 24 by interfittingly engaging the engaging portion 46 in the body 20 of the housing 12. The spacer 18 is then moved toward the extended pin portions 42 of the terminals 14, 16 and the sliding members 40 thereof engage into the positioning members 26 of the housing 12. The pin portions 42 of each terminal 14, 16 are subsequently inserted into the corresponding positioning holes 32 of the spacer 18 and extend therethrough for being inserted into the corresponding aperture of the circuit board 50. The pair of retaining tabs 48 of each terminal 14 of the inner first row is interfittingly engaged with the rectangular slot 34 in the lower first surface 28 of the spacer 18 for stabilizing the spacer 18 relative to the housing 12 thereby preventing the spacer 18 from deflection, deformation, and adverse displacement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an elongate insulative housing comprising a plurality of terminal-receiving passageways and a pair of arms extending from opposite ends thereof;

a plurality of terminals received within the terminal-receiving passageways of the housing and arranged in an inner row and an outer row, at least some terminals in the inner row comprising retaining tabs; and a spacer attached to the arms of the housing, comprising a plurality of positioning holes arranged in an inner row and an outer row for receiving corresponding terminals, and a plurality of slots interfittingly engaged with the terminal retaining tabs in the inner row for restricting horizontal movement of the at least some terminals thereby stabilizing the spacer relative to the housing.

2. The electrical connector as described in claim 1, wherein the spacer comprises a pair of positioning blocks formed on opposite sides thereof, each positioning block having a sliding member; and each arm of the housing comprises a positioning member formed on an inner surface thereof, the positioning members engaging with the positioning blocks to attach the spacer to the housing.

3. The electrical connector as described in claim 1, wherein the slot is substantially rectangular and is disposed in an inner surface of the positioning hole in the inner row.

4. An electrical connector comprising:

an elongated insulative housing comprising a plurality of terminal-receiving passageways;

a plurality of terminals received within the corresponding terminal-receiving passageways, some of said terminals including retaining tabs extending in a horizontal direction, respectively; and a spacer attached to the housing and defining a plurality of positioning holes; wherein a plurality of slots are formed adjacent to and communicative with some of the corresponding positioning holes for snugly receiving the retaining tabs of the corresponding terminals, respectively, so as to stabilize the spacer relative to the housing.

* * * * *